United States Patent [19]

Boyd et al.

[11] 4,044,777

[45] * Aug. 30, 1977

[54] SYNTHETIC SMOKING PRODUCT

[75] Inventors: Dennis Boyd, Belfast, Northern Ireland; George Porter, London, England

[73] Assignee: Gallaher Limited, Belfast, Northern Ireland

[ * ] Notice: The portion of the term of this patent subsequent to Mar. 16, 1993, has been disclaimed.

[21] Appl. No.: 636,705

[22] Filed: Dec. 1, 1975

Related U.S. Application Data

[62] Division of Ser. No. 352,238, April 18, 1973, Pat. No. 3,943,941.

[30] Foreign Application Priority Data

Apr. 20, 1972 United Kingdom ..... 18315/72

[51] Int. Cl.[2] ..... A24B 15/00; A24D 1/18

[52] U.S. Cl. ..... 131/2

[58] Field of Search ..... 131/2, 140 C, 17, 15

[56] References Cited

U.S. PATENT DOCUMENTS

| | | | |
|---|---|---|---|
| 3,545,448 | 12/1970 | Mormon et al. | 131/2 |
| 3,861,401 | 1/1975 | Briskin et al. | 131/2 |
| 3,874,390 | 4/1975 | Eicher et al. | 131/2 |
| 3,943,941 | 3/1976 | Boyd et al. | 131/2 |

*Primary Examiner*—Robert W. Michell
*Assistant Examiner*—V. Millin
*Attorney, Agent, or Firm*—Brisebois & Kruger

[57] ABSTRACT

The invention relates to a fuel for use in a smoking product and consisting of a fibrous flexible self coherent carbonaceous material the fibers of which preferably have certain dimensions and are agglomerated into clusters of certain dimensions. Volatile constituents to give smoking satisfaction are added to the fuel and are distilled or sublimed into a smoke stream upon burning of the fuel.

6 Claims, 1 Drawing Figure

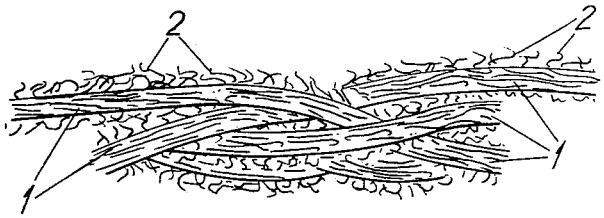
2
2
1
1

SYNTHETIC SMOKING PRODUCT

This application is a division of our prior application Ser. No. 352,238, filed Apr. 18, 1973, now U.S. Pat. No. 3,943,941.

It is generally recognised that the difficulties in assessing any health hazards which may be associated with cigarette smoking arise from the variety and complexity of the combustion products in the smoke which is inhaled. Many of the combustion products are difficult if not impossible to isolate and are present in such small quantities that their pharmacological activity cannot be properly determined. Various approaches have been used in the past for controlling the combustion products which are inhaled, either by replacing natural tobacco with a substitute material of known composition, or by means of filter plugs through which the smoke is drawn.

We have now conceived a fundamentally new approach in which a smoking material is composed of a matrix of a simple fuel which has mechanical properties, that is flexibility, porosity, and self-cohesion, similar to those of natural tobacco, the fuel being impregnated with volatile solid or liquid constituents which are capable of distilling or subliming into a smoke stream without chemical change and thus providing smoke to be inhaled upon burning of the fuel.

By a simple fuel is meant a material which burns in atmospheric air to produce preferably known simple combustion products of well understood toxicology. Probably the most useful fuel is carbon which burns to simple gaseous oxides having a well understood chemistry and with no unknown health risks. However the use of carbon in the form of charcoal, as has previously been proposed for use as a fuel in analogous fields is unsatisfactory because the carbon fuel in that form is incapable of being handled on conventional cigarette making machinery and other tobacco handling equipment.

We find that the criteria can be satisfied by a fuel comprising a fibrous carbonaceous material which is flexible and self-coherent.

The basically fibrous nature of the carbonaceous fuel, of which the fibres may have a cross sectional dimension between 5 micron and 100 micron, and preferably less than 50 micron, contributes to the flexibility and mechanical strength of the fuel and to the ability of the fuel particles to hold together without the need for binders or other adhesive aids. A smoking material composed of a matrix of the fuel can be handled on mechanical devices for cigarette making and can be easily formed into cigarettes with an acceptable pressure drop for smoking.

The fibres of the fuel give good combustion characteristics but we find that the fibres are preferably agglomerated into clusters. The individual fibres provide coherency between clusters but the essential porosity of the fuel is provided by the spaces between the clusters of fibres. By a cluster we mean for example a tow or twisted strand of fibres, either straight or crimped, a felt mat of the fibres, or a shredded paper web of the fibres. The tow or strands may of course be additionally formed into a woven cloth which is cut into small pieces.

The fibres and clusters of fibres are preferably of such a size that the individual fibres have a cross sectional dimension of between 5 micron and 100 micron and a length of between 1 mm and 5 cm; and the clusters have a cross sectional dimension of between 0.1 mm and 5 mm and a length of between 5 mm and 5 cm.

The fuel preferably consists of or includes a carbonaceous material which is the product of controlled pyrolysis of a polymeric organic material and which consists of at least 80%, preferably at least 90% carbon by weight. The organic material is preferably a polymer with a carbon skeleton and containing only carbon and hydrogen or carbon, hydrogen and oxygen. The controlled pyrolysis will in general break down the starting material and the result will then be essentially loose linked carbon chains without any significant quantity of side groups containing oxygen or hydrogen. The combustion products from such a fuel will be essentially oxides of carbon and water which satisfy the criteria for a simple fuel. During the pyrolysis the organic material may suffer an overall weight reduction of between 60% and 80% but its physical characteristics other than simple shrinkage will be largely unchanged. The starting material should therefore also have a flexible fibrous nature.

Examples of suitable fibrous starting materials for the pyrolysis are polyethylene or polypropylene; high purity cellulose based materials such as cotton, cotton linters e.g. after making up into a paper web and shredding, a bast fibre such as ramie, cellulose acetate, or regenerated cellulose such as viscose, and cuprammonium rayon.

To convert the fuel to a smoking material it will have mixed or otherwise impregnated with it the volatile solids or liquids which provide the satisfaction to the smoker. These materials should be stable at the temperature to which they are subjected as a result of the burning of the fuel, that is they should distill or sublime without significant decomposition or other chemical change. In practice the volatile solids or liquids will sublime or distill downstream of the burning zone of the fuel, being heated by conduction and radiation from the burning zone and by contact with the hot combustion products from the fuel. In this way the volatile solids or liquids will not actually be subjected to a temperature as high as that in the burning zone.

The volatile constituents may include pharmacologically or physiologically active agents to give the smoker the stimulation of normal tobacco products or other form of stimulation. Examples of such stimulants are nicotine, caffeine, or other pharmacologically active alkaloids. They may be in salt form in which they can be easily applied and from which they evolve during smoking. The volatile constituents may also include a smoke producing agent which gives a visual and physical impression of smoke from the product, for example by aerosol formation. The smoke producing agents must also be toxicologically acceptable. Examples of suitable materials are alkanes incorporating between 8 and 15 carbon atoms; high boiling point alicyclics such as decalin; high boiling point ethers such as isoamylether; polyhydric alcohols such as propylene glycol, glycerol, and 1,3 butylene glycol; or glyceryl esters such as triacetin.

Further, the volatile constituents may also include flavouring agents to give an aroma to the smoke. Examples are formates, acetates, propionates, and butyrates of terpinols or high molecular weight alicyclic alcohols, menthol, vanillin, or appropriate natural tobacco extracts.

It may also be necessary to include in the smoking material a combustion modifying constituent for example for retarding or sustaining glow, or for ash production.

If the new material is to be used in a cigarette, a wrapper will normally be necessary. As it is essential that the smoke composition is fully understood, contributions to the smoke stream by uncontrolled combustion of cellulosic products are to be avoided as far as possible. The wrapper may therefore either be of an incombustible nature but still sufficiently sensitive to flake off like normal paper, for example in organic films, or a non-porous carbon mat or paper treated in a manner which would prevent the paper combustion products from entering the main smoke stream, such as by coating the surface next to the rod with an intumescent film.

The invention thus enables us to approach the ideal cigarette which incorporates essentially carbon fuel as an open matrix containing only volatiles of known composition and biological activity which are sublimed or distilled off unchanged, and possibly some refractory inorganic materials.

Some examples of materials in accordance with the invention will now be described:

EXAMPLE 1

A carbon smoking material is produced from heavy weave cotton fabric which is broken down into individual strands before pyrolysis. A sample of about 4 g. is placed in a metal boat and plunged into the tube of a furnace at 500° C which is swept with 1000 ml/minute $N_2$. After 15 minutes the sample is removed from the furnace and any further burning is quenched by placing in a beaker with solid carbon dioxide. About 20% of the original sample remains as carbon fibres.

When the sample is cool it is cut into 10 mm lengths to give a material suitable for packing into a cigarette. The material itself burns too rapidly for cigarette use and is treated with a glow retardant by saturating in a solution of 0.75% sodium dihydrogen phosphate followed by drying in an oven for 48 hours at 55° C.

0.3 g. of this carbon smoking material is then packed into a cigarette form using a slow burning cigarette paper of the papirosi type and a 15 mm long cellulose acetate filter.

A sample cigarette was smoked in a standard cigarette smoking machine which drew 35 ml puffs during a 2 second period every minute. Chromatographic analysis was made of a 5 ml sample of the volatile phase at the end of the middle puff during a standard smoking test. It was found that the total volatile organic phase was only 4.3% of that found in a similar analysis on a standard cigarette made from flue-cured tobacco. Analysis of a sample of the side-stream vapour was only 1% of that from the side-stream in a standard cigarette made from flue-cured tobacco.

EXAMPLE 2

Cigarettes were prepared in the same manner as in Example 1 but the carbon cigarette was charged with 5 mg. of ethyl acetate and 5 mg of pure nicotine in 120 μl of glycerol distributed inside the carbon maerial with a syringe and perforated needle.

When these cigarettes were smoked the glycerol produced an aerosol smoke in which satisfactory amounts of the ethyl acetate and nicotine were transformed without significant decomposition.

The accompanying drawing shows a mass of the fuel or smoking material made according to the examples and consisting of strands 1 of fibres 2.

We claim:

1. The method of preparing a fuel for smoking by human beings which comprises the steps of agglomerating a plurality of flexible cellulose-base fibres containing only carbon, hydrogen and oxygen, into a coherent mass, and subjecting said mass to a controlled pyrolysis until said fibres have suffered a weight loss of at least 60% during the pyrolysis, having a cross-sectional dimension between 5 and 10 microns and an organic content which is at least 90% carbon by weight.

2. The method claimed in claim 1, which comprises the additional step of impregnating said pyrolized mass with at least one volatile substance capable of distilling or subliming without chemical change while avoiding impregnation with any substance which will change chemically when it distills or sublimes.

3. The method claimed in claim 2, in which said voltatile substance is selected from the group consisting of pharmacologically or physiologically active substances, smoke-producing substances, and flavour-imparting substances.

4. The method claimed in claim 1, in which said cellulose-based fibre is viscose.

5. The method claimed in claim 2, which comprises the step of impregnating said pyrolized mass with a glow-retardant.

6. The method claimed in claim 1 in which said fibres are non-adhesively agglomerated.

* * * * *